US006177156B1

(12) United States Patent
Glover et al.

(10) Patent No.: US 6,177,156 B1
(45) Date of Patent: Jan. 23, 2001

(54) SIMULATED DIVIDED LIGHT WINDOWS

(75) Inventors: Michael Glover; Stephen Field, both of Ottawa (CA)

(73) Assignee: Bowmead Holding Inc., Ontario (CA)

( * ) Notice: Under 35 U.S.C. 154(b), the term of this patent shall be extended for 0 days.

(21) Appl. No.: 09/193,126

(22) Filed: Nov. 17, 1998

(51) Int. Cl.[7] ..... E06B 3/24

(52) U.S. Cl. ..... 428/34; 428/207; 52/314; 52/455; 52/786.1; 52/786.11

(58) Field of Search ..... 428/34, 120, 195, 428/202, 913; 52/786.1, 314, 455, 786.11

(56) References Cited

U.S. PATENT DOCUMENTS

| | | | |
|---|---|---|---|
| 4,598,520 | 7/1986 | Ellstrom | 52/456 |
| 4,783,938 | 11/1988 | Palmer | 52/171 |
| 5,345,743 | 9/1994 | Baier | 52/455 |
| 5,494,715 | 2/1996 | Glover | 428/34 |

*Primary Examiner*—Donald Loney
(74) *Attorney, Agent, or Firm*—Wenderoth, Lind & Ponack, L.L.P.

(57) ABSTRACT

A sealed glazing unit simulating the appearance of a traditional divided-lite window has spaced apart parallel co-extensive glazing sheets interconnected by a peripheral seal. Muntin grid elements are located on at least two surfaces of the glazing sheets in mutually aligned registration, the elements being of a width sufficient to create a visual illusion of solid muntin bars within the glazing sheet cavity. Each of the muntin grid elements has on one side a relatively dark shade facing interiorly of the glazing unit and in the opposite side a relatively light shade facing exteriorly of the glazing unit, the combination of these shades creating the visual appearance of solid muntin bars within the cavity. Muntin grid elements within the glazing unit are preferably in the form of strips of plastic material adhered to the cavity glass surfaces, whereas muntin grid elements on the exterior surfaces of the unit can alternatively be formed as relatively thick members e.g. of wood, or of hollow aluminum or plastic.

28 Claims, 9 Drawing Sheets

SIMULATED DIVIDED LIGHT WINDOWS

BACKGROUND OF THE INVENTION a) Field of Invention

This invention relates generally to multiple-pane sealed glazing units and more particularly to units that incorporate decorative features that simulate the appearance of traditional divided-lite windows.

b) Description of the Prior Art

In U.S. Pat. No. 5,494,715, issued to Glover, there is a description of the various efforts that have been made in recent years to improve both the energy efficiency and condensation resistance of multiple glazed sealed units. These improvements include: low-e coatings, argon or krypton gas fill, insulating spacingand-desiccant systems for perimeter edge seals and narrow-width cavities (approximately ⅜" spacing for argon gas filled units).

As also noted in U.S. Pat. No. 4,494,715, there is a growing consumer interest in heritage window features. Perhaps the most popular of these features is the addition of muntin bars that create the appearance of colonial style divided-lite windows. In the past, various efforts have been made to simplify the assembly of these divided-lite windows and these efforts have been documented in the patent literature.

U.S. Pat. No. 4,598,520 issued to Ellstrom describes the use of two separate but aligned wood muntin grid assemblies that are permanently adhered to either side of a multiple-pane sealed unit using double-sided adhesive foam tape. When viewed at a somewhat inclined angle, the visual illusion is created of a solid muntin-grid assembly. However, when viewed at a more oblique angle, this visual illusion is lost because daylight can be seen between the two muntin grid assemblies.

U.S. Pat. No. 4,738,938 issued to Palmer describes a muntin-grid window assembly similar to the assembly described in the Ellstrom patent but where an additional metal muntin-grid is also incorporated within the sealed unit. However, although the addition of a metal spacer muntin-grid better simulates the appearance of a divided-lite window, window energy efficiency is reduced because of increased heat loss through the muntin grid assembly.

U.S. Pat. No. 5,345,743 issued to Baier describes a muntin grid window assembly similar to the assembly described in the Palmer patent but where a flexible foam spacer with pre-applied adhesive is substituted for the metal spacer grid. Although more energy efficient than a simulated divided-lite window with a metal spacer muntin-grid, the double muntin grid assembly method still remains a labour intensive manufacturing process and the grid assembly is still a weak link in the thermal envelope.

U.S. Pat. No. 5,494,715 issued to Glover describes how the visual illusion of a muntin grid window is created by means of decorative stripe patterns that are applied to the three separate glazing sheets of a triple glazed unit with the glazing sheets being typically located no more than ⅜" apart.

Traditional wood muntins are typically colored white, and when all three muntin stripes are colored white, experience has shown that because of various shading and optical effects, a convincing visual illusion of a divided lite window is not always created. The decorative surface patterns can be fabricated from a wide range of materials, including inks and paints. Because of potential durability problems, the stripe material must be non-outgassing and with high volume production methods, experience has again shown that for typical coating materials, this is a very demanding technical requirement.

SUMMARY OF THE INVENTION

The present invention provides a sealed glazing unit that simulates the appearance of a traditional divided-lite window, said sealed glazing unit comprising: two spaced apart parallel co-extensive glazing sheets; a peripheral seal extending continuously between the edges of said glazing sheets to define an insulating cavity between said two glazing sheets; muntin grid elements located on at least two surfaces of said glazing sheets, said muntin grid elements on respective surfaces being in mutually aligned registration with each other and of a width parallel to the glazing sheet surfaces that is sufficient to create the visual illusion of solid muntin bars within said cavity; wherein each said muntin grid element has one side that is of a relatively light shade and an opposite side that is of a relatively dark shade, said elements being attached to said glazing sheets in an orientation such that the side of relatively light shade is presented towards the adjacent exterior side of the glazing unit whereas the side of relatively dark shade is presented towards the opposite side; wherein at least one of said two surfaces is located within said cavity, the muntin grid elements on said at least one surface comprises a decorative grid pattern that is in the form of thin strips applied to said one surface.

The thin strips are preferably made from a flexible tape that carries a pre-applied pressure sensitive adhesive thereon, the tape most preferably being of plastic sheet material such as polyethylene terephthalate. The adhesive may be at least partially of acrylic material. The strips incorporate a dark shade coating on one side, the other side being of a light shade to create the above discussed appearance.

Instead of strips of plastic material, the muntin grid elements could be formed by applying a layer of ceramic frit material, and this material can readily be formulated to be dark on one side and light on the other.

The muntin grid elements or muntin pattern elements on both of the glazing sheets may both be within the insulating cavity, but since all of the strips are relatively thin, they do not significantly detract from the heat insulation properties of the cavity. The glass sheets are preferably spaced no more than about 10 mm apart, and the cavity filled with argon gas or the like.

The invention also provides a sealed glazing unit that simulates the appearance of a traditional divided-lite window, said sealed glazing unit comprising:

three spaced apart parallel co-extensive glazing sheets; a peripheral seal extending continuously between the edges of said glazing sheets to define a respective insulating cavity between each adjacent pair of said glazing sheets; first muntin grid elements located on the outer surfaces of the outer two of said glazing sheet, secondary muntin grid elements being in the form of thin strips attached to the central one of said glazing sheets, said muntin grid elements on respective surfaces being in mutually aligned registration with each other and of a width parallel to the glazing sheet surfaces that is sufficient to create the visual illusion of solid muntin bars within said cavity; wherein each of said first muntin grid elements has one side that is of a relatively light shade and an opposite side that is of a relatively dark shade, said elements being attached to said glazing sheets in an orientation such that the side of relatively light shade is presented towards the adjacent exterior side of the glazing unit whereas the side of relatively dark shade is presented towards the opposite side; and wherein said secondary muntin grid elements have opposite sides that are both of a shade corresponding to said relatively dark shade.

The secondary muntin grid elements may take any of the forms discussed in the foregoing. The first muntin grid elements may be in the form of thin strips attached to the cavity faces of said outer glazing sheets. Alternatively they may comprise bulky profile members, but in either case they include outwardly presented surfaces that are of the relatively light shade and surfaces presented towards the interior of the cavity having the appearance of the relatively dark shade. The bulky profiles can be adhered to the glazing sheets by the use of adhesive foam tapes, and may for example be formed by co-extruded PVC profiles. In this case the PVC profile will comprise a rigid hollow PVC profile with flexible longitudinal edge fins to engage against the glass surface. These fins, as well as the adhesive foam tape securing the profile to the glass, will be of the dark shade.

Alternatively the bulky profile members may be of wood or they comprise aluminum extrusions.

The central glazing sheet may comprise a tensioned flexible film incorporating pre-applied secondary grid elements.

BRIEF DESCRIPTION OF THE DRAWINGS

The following is a description by way of example of certain embodiments of the present invention, reference being made in the accompanying drawings, in which.

DESCRIPTION OF THE PREFERRED EMBODIMENTS

Figure 1:
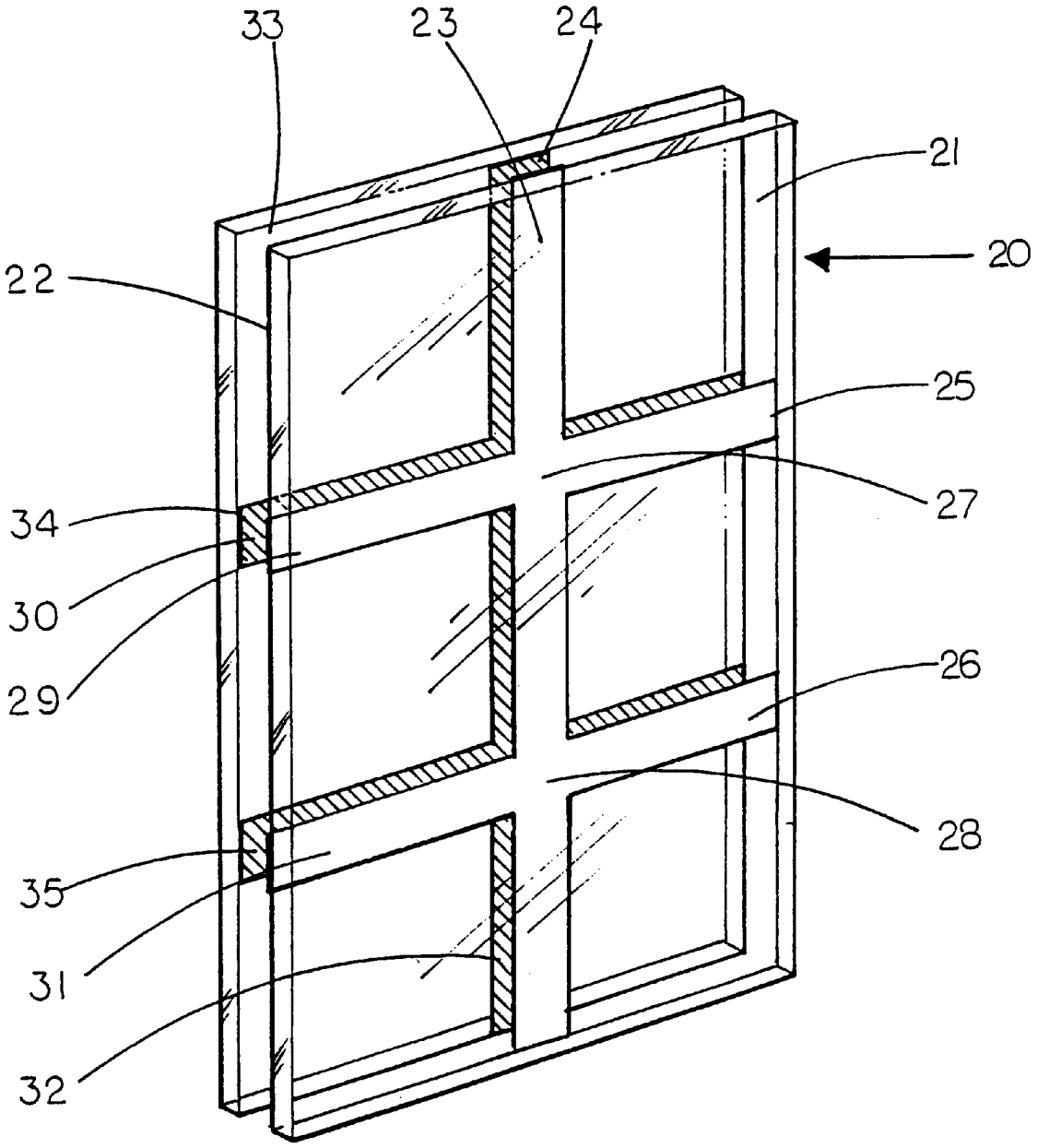
FIG. 1 shows a fragmentary perspective view of a double glazing assembly that simulates the appearance of a muntin grid window.

FIG. 1 shows a fragmentary perspective view of a double glazing assembly that simulates the appearance of a traditional divided-lite window. The double glazed unit 20 consists of an inner and outer rigid glazing sheets 21 and 22 which are typically spaced less than 10 mm apart (⅜" approx.). The rigid glazing sheets are typically made from glass although plastic and other transparent sheet materials can also be used.

A vertical strip of adhesive tape material 23 is applied to the cavity surface 24 of the inner glazing sheet 21. To create a grid pattern, horizontal strips 25 and 26, are applied at right angles to the vertical strip 23. At the intersection points 27 and 28 between the vertical and horizontal strips, the horizontal strips 25 and 26 are simply laid over the vertical strip 23. With ⅜" cavity, the width of the adhesive tapes 23 material is preferably about ⅝", but could be anywhere from ½" to ¾" or even longer. A minimum width of about ½" is required to provide the desired visual effect.

The adhesive tape material is typically made from plastic sheet materials with a pre-applied pressure sensitive adhesive. One preferred material option for the plastic sheet material is polyethylene terephthalate (PET), and acrylic is the preferred material option for the pressure sensitive adhesive. The outer adhesive surface 29 of the tape is coloured a relatively light shade while the inner surface 30 of the tape is coloured a relatively dark shade. For muntin grid windows, the lighter shade is typically white while the darker shade is typically black.

For ease of application, and so there is no need to bend or stretch the tape at the intersection points 27 and 28, the sheet material thickness should be less than 0.005" and preferably 0.002" or less. The thickness of the adhesive material is typically about 0.001" in thickness.

A second vertical adhesive tape strip 32 is applied to the cavity surface 33 of the outer glazing sheet 22. The second strip 32 is generally in coincidental alignment with the first strip 23. A second set of horizontal strips 34 and 35 are similarly applied to the cavity surface 33 of the outer glazing sheet 22 and again this second set of horizontal stripes is in coincidental alignment with the first set.

When viewed at an oblique angle as seen in FIG. 1, the eye sees both the light-color surface 29 of adhesive tape 31 on the inner glazing sheet 21 as well as part of the inner dark surface 30 of the adhesive tape 31 on the outer glazing sheet 22. Because of the narrow spacing between the glazing sheets 21 and 22, and the width of the adhesive tape 23 and the dark colored inner surface 30, the visual illusion is created of a solid muntin profile.

Although a simple grid pattern is shown in FIG. 1, it can be appreciated by those skilled-in-the-art that a wide variety of different strip patterns can be created. These traditional muntin grid patterns can include: Gothic, Victorian, Georgian, Queen Anne, Cathedral, Tudor, Arch, Sunburst, Sunray and Austrian patterns.

Figure 2:
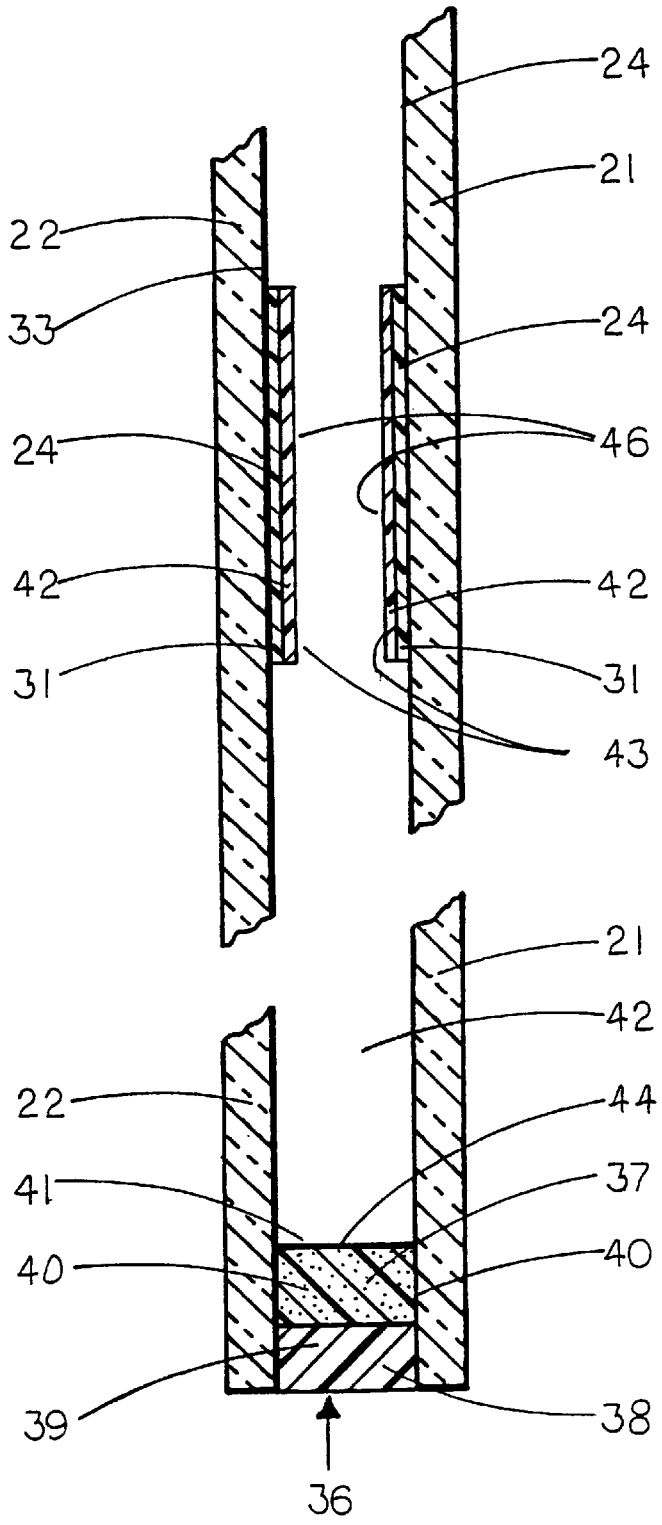
FIG. 2 shows a cross sectional bottom-edge detail of a double glazing assembly that simulates the appearance of a muntin grid window.

FIG. 2 shows a bottom edge cross sectional detail of the double glazing assembly shown in FIG. 1. The two glazing sheets 21 and 22 are conventionally sealed at the perimeter edge 36.

Although different types of perimeter edge seals can be used, one preferred option is the combination of an insulating foam spacer 37 and thermoplastic sealant 38. The insulating foam spacer 37 is made from silicone or EPDM rubber-sponge material that incorporates desiccant fill. A vapour barrier backing 39 is laminated to the back face of the spacer and a pressure sensitive acrylic adhesive is incorporated on the spacer sides 40. The front face 44 features a smooth non-reflective finish that can be color matched with the dark shade color of the adhesive tape strip 31. Marketed under the name of Super Spacer®, the insulating foam spacer 37 is manufactured by Edgetech IG of Cambridge, Ohio.

As previously described, a light-and-dark adhesive tape 31 is applied to the glazing cavity surfaces 24 and 33. The light-and-dark adhesive tape 31 is adhered to the glazing sheets with a pre-applied pressure sensitive adhesive 43. Although various adhesive materials can be used, one preferred option is to use an acrylic pressure sensitive adhesive. The light-and-dark tape 31 can be made from various sheet materials with plastic film being the preferred option. Different plastic sheet materials can be used with polyethylene terephthalate (PET) being one preferred material option.

As shown in FIG. 2, the light-and-dark adhesive tape is made from white PET film material 42 that is finished with a black paint or coating 46. Alternatively, the light-and-dark color tape material can be made from separate white and black PET film sheet materials that are laminated together. A further option is for the light-and-dark adhesive tape to be made from PET sheet material that is dark in color with a pre-applied adhesive layer that is light in color.

Because the adhesive tape is located within a sealed unit, both the plastic sheet and adhesive must be non-outgassing and pass the demanding test requirement of the Canadian CGSB 12.8 volatile fogging test procedure. The tape material must also be color stable and not fade or yellow over time.

Although the strips illustrated in FIG. 2 are made from adhesive tape, it can be appreciated by those skilled-in-the-art that the light-and-dark stripes can be made from various materials including: multi-layers of UV paints, inks and ceramic frit material.

Compared to inks or paints the main advantage of using adhesive tape is that the material is fully cured and potential problems with volatile outgassing can be minimized. Also, compared to paints and inks, the two color tone adhesive tape can be applied both at high speeds and in a single pass operation.

In case of ceramic frit material, a two tone, heat transfer decal can be used and this allows for a single pass operation. The ceramic frit material is fused to the glass at high temperatures and as a result, there is no volatile outgassing or color fading. A strip or material element that forms the pattern on a single glazing sheet can be referred to generically as a muntin pattern element.

Figure 3:
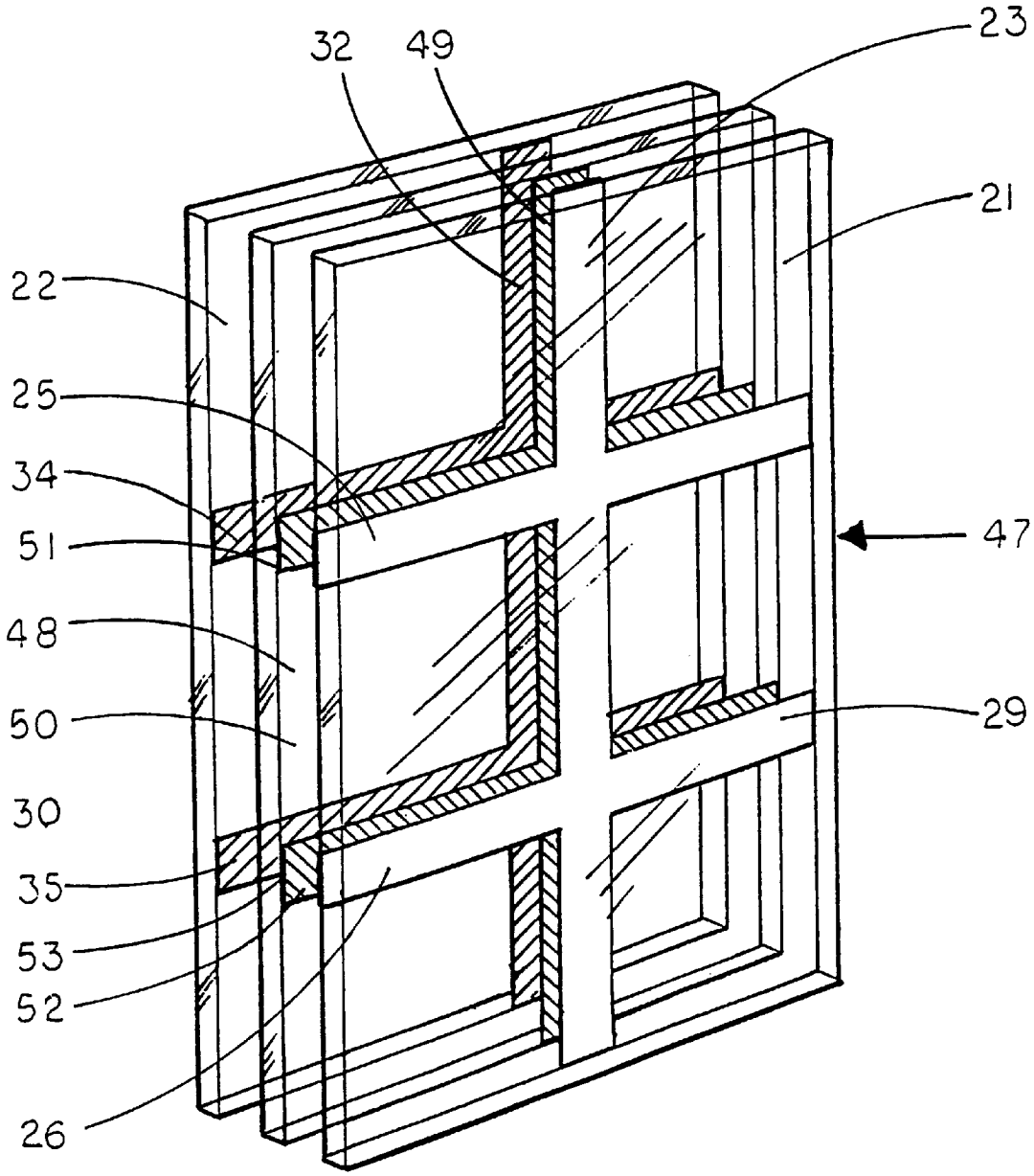
FIG. 3 shows a fragmentary perspective view of a triple glazing assembly that simulates the appearance of a muntin grid window.

FIG. 3 shows a fragmentary perspective view of a triple glazing assembly that simulates the appearance of a traditional muntin grid window. The triple glazed unit 47 consists of an inner and outer rigid glazing sheet 21 and 22, and also a center glazing sheet 48. The three glazing sheets are typically spaced less than 10 mm (⅜") apart. Generally all three glazing sheets are fabricated from flat glass sheet material although the center glazing sheet 48 can also be made from a tensioned, flexible plastic film.

As with the double glazing unit shown in FIG. 2, a vertical light-and-dark strip 23 and horizontal strips 25 and 26 are applied in a grid pattern to the cavity side of inner glazing sheet 21. A vertical light-and-dark strip 32 and horizontal strips 34 and 35 are also applied to the cavity side of outer glazing sheet in coincidental alignment with the first grid pattern. Both sets of light-and-dark strips are about ⅝" in width.

A vertical dark strip 49 is applied to the interior cavity surface 50 of the center glazing pane 48 and this strip 49 is generally in coincidental alignment with the outer two strips 23 and 32. Similarly, horizontal dark strips 51 and 52 are also applied to the interior cavity surface 50 of center glazing sheet 48 and these strips 51 and 52 are also in coincidental alignment with the outer two sets of strips 25,34 and 26,35. In combination, the dark strips 49,51 and 52 create a grid pattern that is generally in coincidental alignment with the grid patterns on the inner and outer glazing sheets.

As shown in FIG. 3, one option is for the center pane strips 49,51 and 52 to be about ¼" larger in width than the two sets of strips 23,25,26 and 32,34,35 on the two outer glazing sheets 21 and 22.

When viewed at an oblique angle, the eye sees both the outer light surface 29 of the adhesive tape on the inner glazing sheet 21 as well as part of the dark surface 53 on the center glazing pane 48 and the inner dark surface 30 of the adhesive tape 31 on the outer glazing sheet 22. Because of the dark colored surfaces 30 and 52, and also because of the narrow spacing between the glazing sheets 21, 48 and 22, a visual illusion of a solid muntin profile is created.

Figure 4:
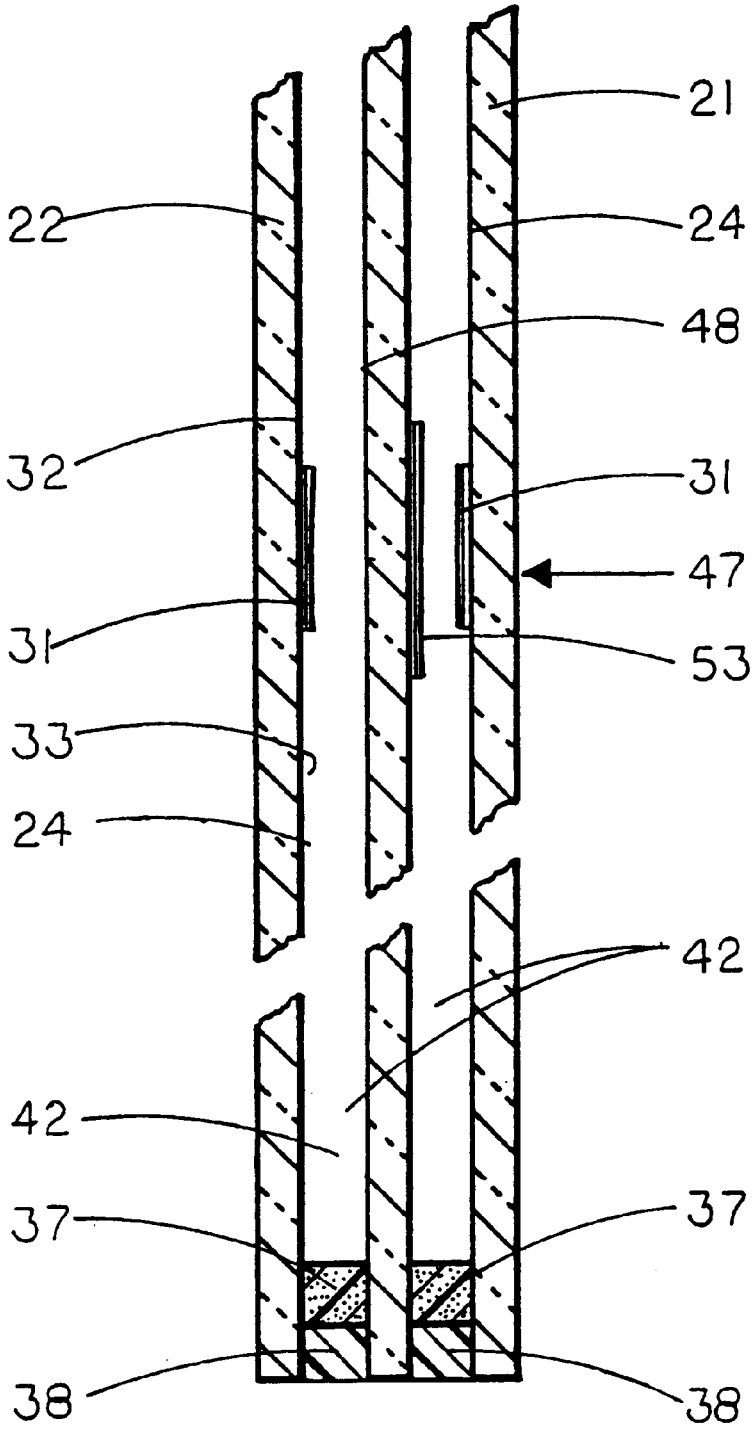
FIG. 4 shows a cross section bottom edge detail of a triple glazing assembly that simulates the appearance of a muntin grid window.

FIG. 4 shows a bottom edge cross sectional detail of the tripleglazed unit 47 shown in FIG. 3. For improved energy efficiency, the cavity spaces 42 between the glazing sheets 21,48 and 22 are typically filled with argon gas. The three glazing sheets 21,48 and 22 are conventionally sealed at the perimeter edge and one preferred edge-seal configuration is the combination of desiccant filled, thermoset rubber foam spacers 37 and thermoplastic sealant material 38.

As previously described, light-and-dark adhesive tape material 31 is applied in a grid pattern to the cavity surfaces 24 and 33. A dark tape 53 is applied in a grid pattern to one of the cavity surfaces of the center glass pane 48. Although various plastic sheet materials can be used, one preferred option is to fabricate the dark tape 53 from PET film material.

Figure 5:
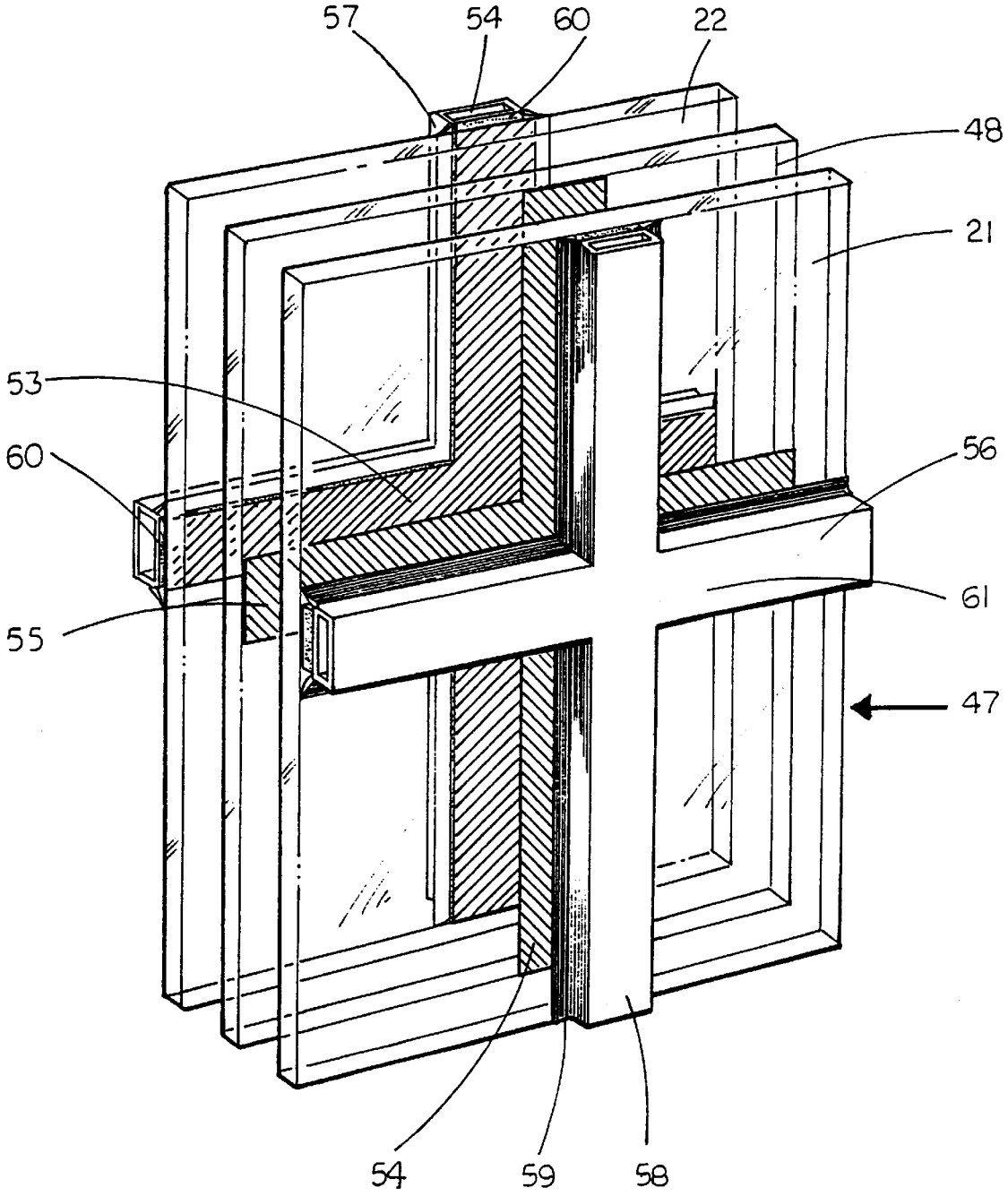
FIG. 5 shows a fragmentary perspective view of a triple glazing unit that simulates the appearance of a divided-lite window with co-extruded PVC plastic muntin profiles adhered to the outer surface of the glazing unit.

FIG. 5 shows a fragmentary perspective view of a triple glazing unit 47 that simulates the appearance of a divided-lite window with co-extruded PVC plastic muntin profiles 54. The triple glazed unit 47 consists of an inner and outer rigid glazing sheets 21 and 22 and a center glazing sheet 48. Typically the three glazing sheets 21, 22 and 48 are spaced less than 10 mm (⅜") apart. A decorative grid pattern 55 is applied to the center glazing pane 48 and typically, the decorative grid pattern 55 is made from plastic sheet tape material with a pre-applied pressure sensitive adhesive. As previously noted, the preferred tape material is PET film and the preferred adhesive is acrylic.

Linear rigid profiles 56 and 57 are applied to the inner and outer glazing sheets 21 and 22 and the profiles 56 and 57, are generally in coincidental alignment with the center grid pattern 55. The rigid profiles can be made from various materials and one preferred option is for the profile to be made from a hollow PVC co-extrusion 61 consisting of a rigid light colored hollow channel 58 and flexible outer dark colored longitudinal perimeter edge fins 59. Generally, the edge fins 59 are similar in shape and size to the co-extruded glazing seals of the PVC window frame (not shown).

The profiles 56 and 57 are applied to the glazing sheets 21 and 22 using adhesive foam tape 60. Although various material options can be used, one preferred material configuration is a dark colored polyethylene foam with pre-applied pressure sensitive acrylic adhesive.

When the composite muntin grid assembly is viewed at an oblique angle, the visual illusion is created of a traditional divided-lite window. This illusion is enhanced if the adhesive foam tapes 60, the flexible PVC extrusion edge fins 59, the tape grid strips 53 and the perimeter spacer 37 (FIG. 6)

are essentially the same dark color and because of material availability, the preferred color is black.

Figure 6:
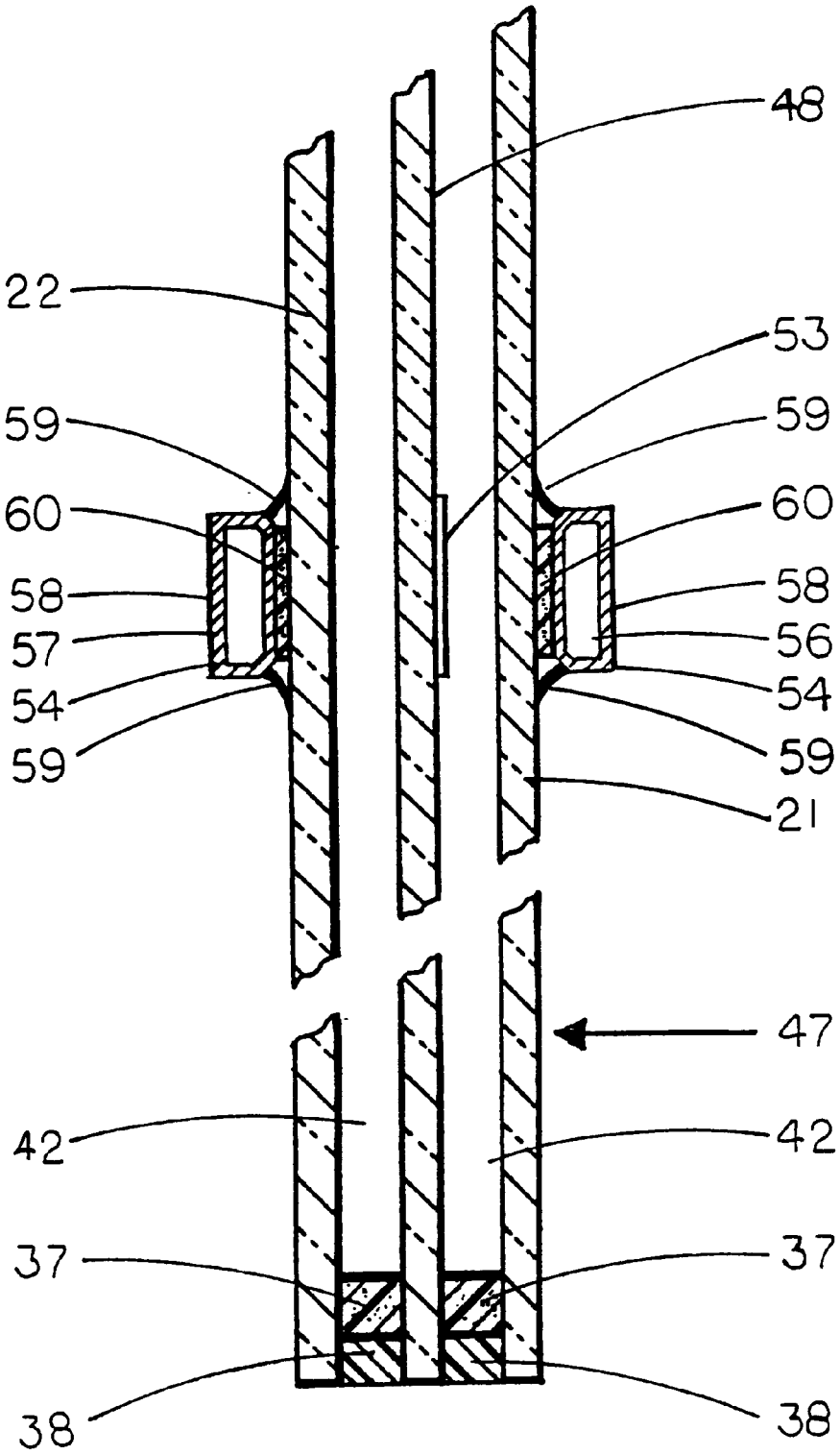
FIG. 6 shows a cross sectional detail of a triple glazing unit that simulates the appearance of a divided-lite window with PVC plastic muntin profiles adhered to the outer surfaces of the glazing unit.

FIG. 6 shows a bottom-edge cross sectional detail of the triple glazed unit shown in FIG. 5. The three glazing sheets 21,48 and 22 are conventionally sealed at the perimeter edge and as previously noted, one preferred option is to use the combination of desiccant-filled, thermoset rubber foam spacers 37 and thermoplastic sealant material 38. Dark shade adhesive tape material 53 is applied in a grid pattern to one of the cavity surfaces of the center glass sheet 48. Linear hollow channel, PVC profiles 56 and 57 are adhered to the outer surfaces of glazing sheets 21 and 23 using adhesive foam tape 60 and the profiles are in coincidental alignment with the dark shade stripe 53 on the center glass pane 48. Generally, the width of the dark colored center strip 53 is about ⅛" less than the width of the co-extruded PVC profiles 54.

To create the visual illusion of a single muntin profile, it is important that the dark colored foam tape 60 fully covers the light colored PVC channel 58 and also fully extends between the two flexible dark colored edge fins 59.

Figure 7:
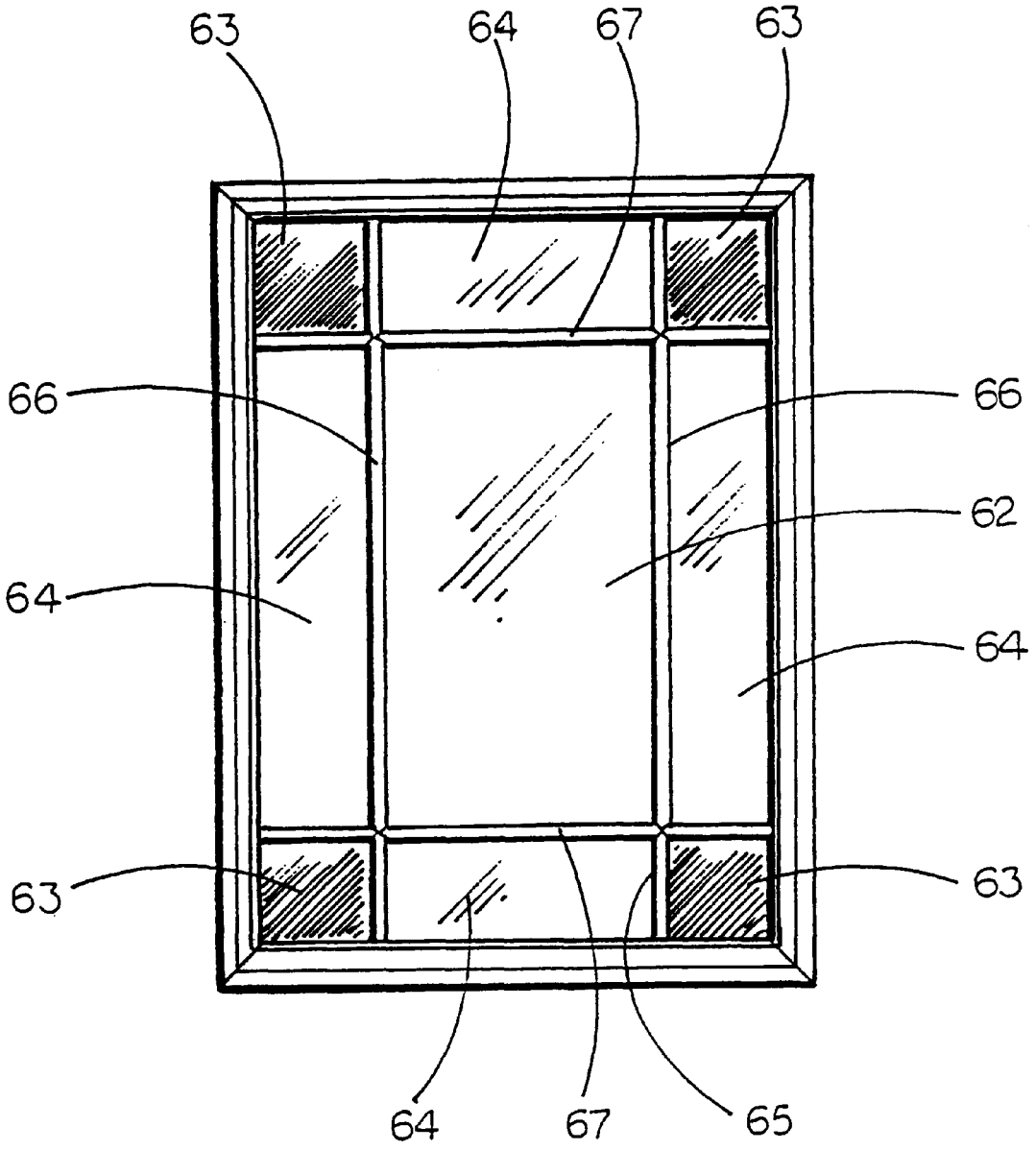
FIG. 7 shows an elevational view of a triple glazing unit that simulates the appearance of a simulated divided-lite window with an Austrian-pattern decorative border trim.

FIG. 7 shows an elevational view of a triple glazing unit that simulates the appearance of a divided-lite window with an Austrian pattern, decorative border trim. The traditional Austrian pattern typically consists of a clear center glazing panel 62, four colored corner panels 63 and four decorative edge, infill panels 64. The three different panel areas are separated by a muntin profile grid 65 that consists of two vertical profiles 66 and two horizontal profiles 67.

Figure 8:
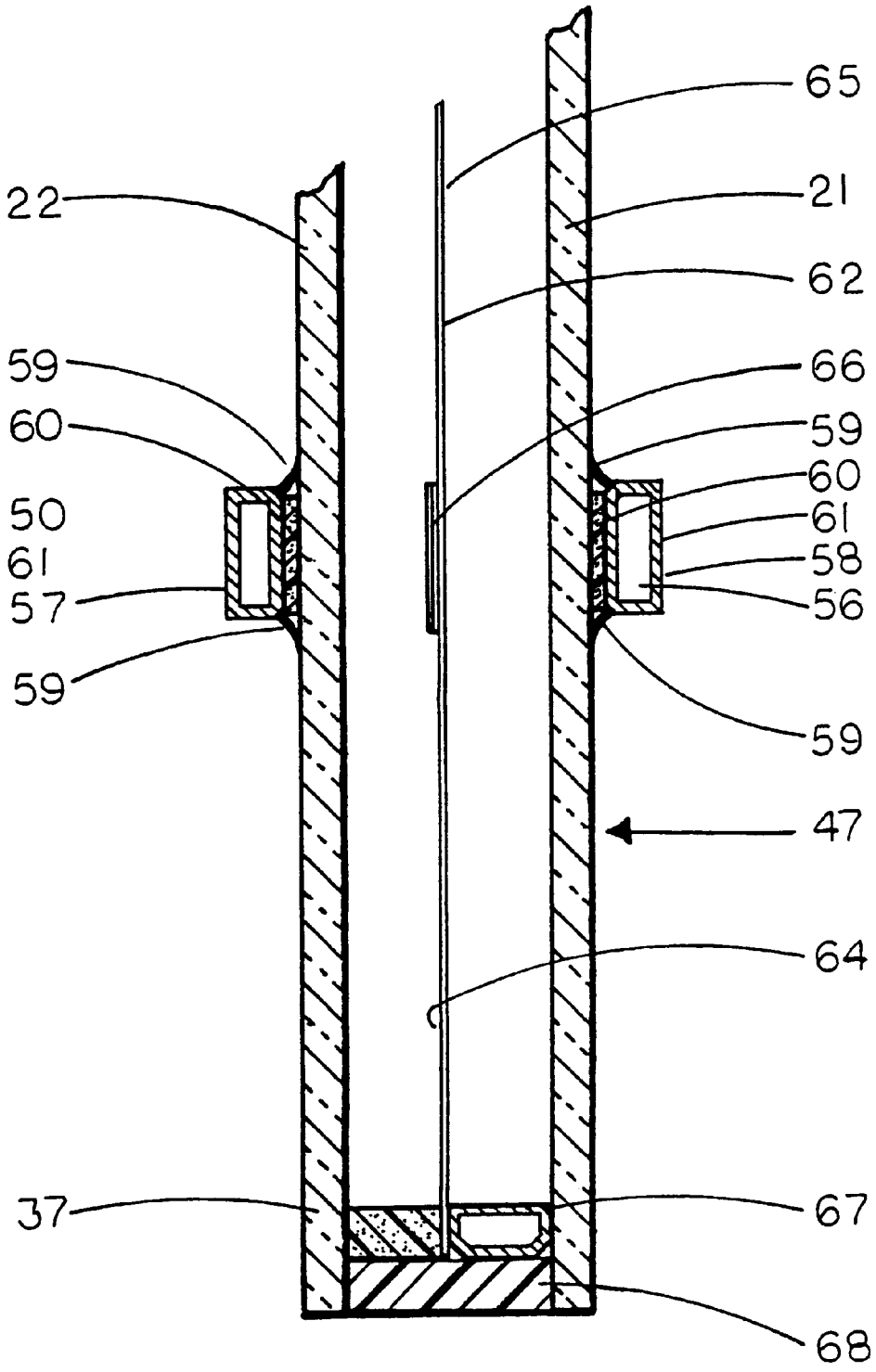
FIG. 8 shows a cross sectional, bottom edge detail of a triple glazing unit that simulates the appearance of simulated divided- lite window with an Austrian pattern decorative border trim.

FIG. 8 shows a cross sectional, bottom edge detail of a triple glazing unit 47 that simulates the appearance of a simulated divided lite window featuring an Austrian pattern decorative border trim. The triple glazing unit 47 incorporates a center glazing flexible PET film 65, with a pre-applied printed pattern. To provide a smooth, wrinkle-free surface, the flexible PET film is tensioned using either heat or cold tensioning processes. The flexible film 65 is held in tension at the perimeter edge by means of a composite edge-seal construction consisting of an insulating foam spacer 37, a hollow steel spacer 67 and polyurethane thermoset sealant 68.

The pre-applied printed pattern consists of a clear center panel 62, colored corner panels (not shown), and translucent infill edge panels 64. The center and infill edge panels 62 and 64 are separated by a dark opaque strip 66 and the different decorative opaque, colored, and translucent patterns are directly applied to the flexible film using conventional printing techniques.

Co-extruded PVC profiles 61 are adhered to the inner and outer glazing sheets 21 and 22 with dark adhesive foam tape 60 and the profiles are in coincidental alignment with the printed dark stripe 66. When viewed at an oblique angle, because of the inner dark surfaces, a visual illusion is created of a single muntin profile. Instead of a flexible film for the center glazing pane, a rigid glass sheet can be substituted and to create the required decorative pattern, various pieces of decorative adhesive film can be laminated to the perimeter edge of the rigid sheet.

Figure 9:
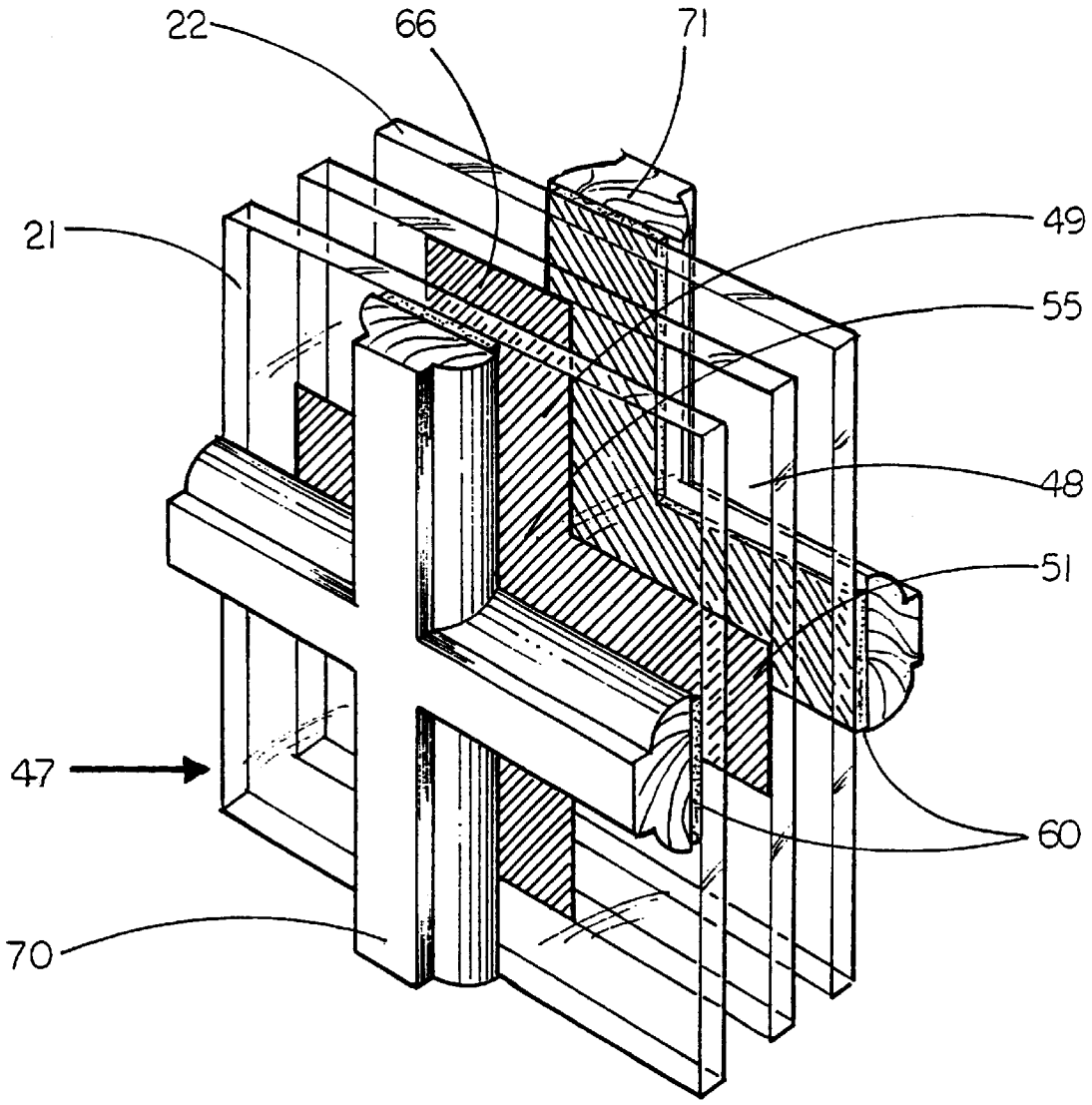
FIG. 9 shows a fragmentary perspective view of a triple glazing unit that simulates the appearance of a divided-lite window and features wood muntin profiles adhered to the glazing unit.

FIG. 9 shows a fragmentary perspective view of a triple glazing sheet 47 that simulates the appearance of a traditional divided-lite window and features wood muntin profiles 70 adhered to the glazing unit 47.

A decorative grid pattern 55 is applied to the center glazing sheet and typically the decorative grid pattern consists of a series of vertical 49 and horizontal 51 dark stripes made from adhesive plastic film material. Solid wood profiles 70 and 71 are adhered to the external surfaces of the glazing sheets 21 and 22 and the profiles 70 and 71 are generally in coincidental alignment with the center grid pattern 55. The profiles 70 and 71 are adhered to the glazing sheets 20 and 22 using dark shade adhesive foam tape and it is important that this foam tape fully extends across the bottom face of the wood profile.

When the composite muntin grid assembly is viewed at an oblique angle, the visual illusion is created of a traditional divided lite window. Although both profiles in FIG. 9 are made from wood, an alternative option is for the interior profile to be made from wood while the exterior profile that is exposed to the weather is made from a hollow aluminum extrusion.

What is claimed is:

1. A sealed glazing unit that simulates the appearance of a traditional divided-lite window, said sealed glazing unit comprising:

a pair of spaced apart parallel co-extensive glazing sheets;

a peripheral seal extending continuously between edges of said glazing sheets to define an insulating cavity between said glazing sheets;

a pair of muntin pattern elements respectively located on two surfaces of said glazing sheets, said pair of muntin pattern elements being in mutually aligned registration with each other and of a width parallel to the glazing sheet surfaces that is sufficient to create the visual illusion of solid muntin bars;

wherein each of said muntin pattern elements has an inward face and an outward face, such that said inward faces of said muntin pattern elements face toward each other and said outward faces of said muntin pattern elements face away from each other toward the exterior of said insulating cavity;

wherein said outward faces of said muntin pattern elements are of a relatively light shade and said inward faces of said muntin pattern elements are of a relatively dark shade which is darker than said relatively light shade; and wherein at least one of said two surfaces of said glazing sheets is located within said cavity, and said muntin pattern element on said at least one of said two surfaces comprises a decorative pattern that is in the form of thin strips applied to said one surface.

2. The sealed glazing unit of claim 1 wherein said thin strips are made from flexible tape that carries pre-applied pressure sensitive adhesive thereon.

3. The sealed glazing unit of claim 2 wherein said flexible tape is made from plastic sheet material.

4. The sealed glazing unit of claim 3 wherein said plastic sheet material is made from polyethylene terephthalate material.

5. The sealed glazing unit of claim 2 wherein said adhesive is made at least in part from acrylic material.

6. The sealed glazing of claim 2 wherein said plastic sheet material incorporates a dark shade coating on one side.

7. The sealed glazing unit of claim 1 wherein said thin strips are made from ceramic frit material.

8. The sealed glazing unit as claimed in claim 1 wherein said relatively dark shade is at least close to black.

9. The sealed glazing unit as claimed in claim 1 wherein said relatively light shade is at least close to white.

10. The sealed glazing unit of claim 1 wherein said peripheral seal has a front face presented towards the cavity that is non-reflective and of a shade similar to said relatively dark shade.

11. The sealed glazing unit as claimed in claim 1 wherein said muntin pattern elements are in the form of thin strips applied to cavity side surfaces of said pair of glazing sheets.

12. The sealed glazing unit of claim 11 wherein said pair of glazing sheets are spaced no more than about 10 mm apart.

13. The sealed glazing unit of claim 1 wherein said muntin pattern elements comprise muntin grid elements, respectively, and said decorative pattern comprises a decorative grid pattern.

14. The sealed glazing unit of claim 1, wherein said peripheral seal has a front face presented inwardly toward said cavity and color matched with said relatively dark shade.

15. A sealed glazing unit that simulates the appearance of a traditional divided-lite window, said sealed glazing unit comprising:

three spaced apart parallel co-extensive glazing sheets, said three glazing sheets including a pair of outer glazing sheets and an inner glazing sheet disposed between said outer glazing sheets;

a peripheral seal extending continuously between edges of said glazing sheets to define an insulating cavity between each adjacent pair of said glazing sheets;

a pair of first muntin pattern elements respectively located on outer surfaces of said outer glazing sheets, and a second muntin pattern element attached to said inner glazing sheet, said first and second muntin pattern elements being in mutually aligned registration with each other and of a width parallel to the glazing sheet surfaces that is sufficient to create the visual illusion of solid muntin bars;

wherein each of said first muntin pattern elements has an inward face and an outward face, such that said inward faces of said first muntin pattern elements face toward each other and said outward faces of said first muntin pattern elements face away from each other toward an exterior of said insulating cavity;

wherein said outward faces of said first muntin pattern elements are of a relatively light shade and said inward faces of said first muntin pattern elements are of a relatively dark shade which is darker than said relatively light shade; and wherein said second muntin pattern element has opposite faces that are both of a shade corresponding to said relatively dark shade, and said second muntin pattern element is in the form of thin strips attached to said inner glazing sheet.

16. The sealed glazing unit of claim 15, wherein said peripheral seal has a front face presented inwardly toward said cavity and color matched with said relatively dark shade.

17. The sealed glazing unit of claim 15, wherein said first and second muntin pattern elements comprise first and second muntin grid elements, respectively.

18. The sealed glazing unit of claim 15 wherein first muntin pattern elements are in the form of thin strips applied to the cavity faces of said outer glazing sheets.

19. The sealed glazing unit of claim 15 wherein said inner glazing sheet is spaced apart no more than about 10 mm from both of said outer glazing sheets.

20. The sealed glazing assembly unit of claim 15 wherein said first muntin pattern elements comprise bulky profiled members attached to exterior surfaces of said outer glazing sheets, respectively, each of said bulky profiled members having outwardly facing surfaces that are of said relatively light shade.

21. The sealed glazing unit of claim 20 wherein said second muntin pattern element is in the form of thin strips applied to said inner glazing sheet.

22. The sealed glazing unit of claim 20 wherein said inner glazing sheet is spaced apart no more than about 10 mm from both said outer glazing sheets.

23. The sealed glazing unit as claimed in claim 16 wherein said bulky profiled members are adhered to said outer glazing sheets by adhesive foam tape.

24. The sealed glazing unit of claim 20 wherein at least one of said bulky profiled members comprises a co-extruded, rigid PVC hollow profile with flexible longitudinal edge fins for engaging the outer surface of the respective outer glazing sheet.

25. The sealed glazing unit of claim 24 wherein said bulky profiled members are adhered to said outer glazing sheets by adhesive foam tape; and wherein said adhesive foam tape and said longitudinal edge fins are essentially the same dark shade.

26. The sealed glazing unit of claim 20 wherein said inner glazing sheets comprises a tensioned flexible film, and said second muntin pattern element comprises a pre-applied second pattern element.

27. The sealed glazing unit of claim 20 wherein at least one of said bulky profiled members are made from wood.

28. The sealed glazing unit of claim 20 wherein at least one of said bulky profiled members are made from an aluminum extrusion.

* * * * *